US009791222B2

(12) United States Patent
Jiang et al.

(10) Patent No.: US 9,791,222 B2
(45) Date of Patent: Oct. 17, 2017

(54) RUBBER BALL CLEANING MULTIPOINT CENTRALIZED BALL SERVING SYSTEM FOR CONDENSER

(71) Applicants: Pingsuo Jiang, Gansu (CN); Jieyu Jiang, Gansu (CN)

(72) Inventors: Pingsuo Jiang, Gansu (CN); Jieyu Jiang, Gansu (CN)

(73) Assignee: SHAANXI HAND ENERGY CONSERVATION AND ENVIRONMENTAL PROTECTION TECHNOLOGY CO., LTD, Xi'An (CN)

( * ) Notice: Subject to any disclaimer, the term of this patent is extended or adjusted under 35 U.S.C. 154(b) by 109 days.

(21) Appl. No.: 14/774,534

(22) PCT Filed: May 19, 2014

(86) PCT No.: PCT/CN2014/077763

§ 371 (c)(1),
(2) Date: Sep. 10, 2015

(87) PCT Pub. No.: WO2015/131444

PCT Pub. Date: Sep. 11, 2015

(65) Prior Publication Data

US 2016/0084594 A1 Mar. 24, 2016

(30) Foreign Application Priority Data

Mar. 5, 2014 (CN) ..... 2014 1 0078002

(51) Int. Cl.
*F28G 1/12* (2006.01)
*B08B 9/055* (2006.01)

(52) U.S. Cl.
CPC ..... *F28G 1/12* (2013.01); *B08B 9/0551* (2013.01); *B08B 9/0553* (2013.01)

(58) Field of Classification Search
CPC ..... F28G 1/12; B08B 9/0551; B08B 9/0553
(Continued)

(56) References Cited

U.S. PATENT DOCUMENTS 3,872,920 A * 3/1975 Honma ..... F28G 1/12 122/379
3,919,732 A * 11/1975 Honma ..... F28G 1/12 15/3.51

(Continued)

FOREIGN PATENT DOCUMENTS

CN 201016635 2/2008
CN 101504263 8/2009

(Continued)

OTHER PUBLICATIONS

International Search Report for International Application PCT/CN2014/077763, in both English and Chinese, dated Dec. 9, 2014, total 6 pages.
International Search Report (in Chinese) for International Application PCT/CN2014/077763, dated Dec. 9, 2014, 5 pgs.

*Primary Examiner* — Justin Jonaitis
(74) *Attorney, Agent, or Firm* — Hamre, Schumann, Mueller & Larson, P.C.

(57) ABSTRACT

A rubber ball cleaning multipoint centralized ball serving system for a condenser includes a condenser water chamber, a cooling water outlet pipe, a cooling water inlet pipe, a ball recovery net, a second isolating valve, a rubber ball pump, and a check valve. A water inlet end of the condenser water chamber is connected to a plurality of pulse ball serving valves. The plurality of pulse ball serving valves is connected to a ball adding chamber via a rubber ball transfer pipe. The rubber ball transfer pipe is connected to the cooling water inlet pipe via another pulse ball serving valve. The ball adding chamber is connected to the circulating cooling water outlet pipe via a hot water discharging pipe. The hot water discharging pipe is provided with a third isolating valve and a hot water discharging valve. A lower portion of the ball adding chamber is provided with a rubber ball discharge valve. The present system can reduce a
(Continued)

quantity of the circulating cooling water that is heated during running of the rubber ball system and again enters the water inlet pipe of the circulating cooling water system, thereby improving a condenser circulating cooling effect. By oppositely and correspondingly operating a pulse ball serving valve and a hot water discharging valve to open or close, a great number of rubber balls are enabled to centrally enter the circulating cooling water inlet pipe and the condenser water chamber within a short time, thereby cleaning the condenser heat exchange pipe in full coverage.

7 Claims, 3 Drawing Sheets

(58) Field of Classification Search
USPC ..... 165/95, 303
See application file for complete search history.

(56) References Cited

U.S. PATENT DOCUMENTS

| | | | | | |
|---|---|---|---|---|---|
| 3,978,917 | A | * | 9/1976 | Honma | F28G 1/12 15/3.51 |
| 4,314,604 | A | * | 2/1982 | Koller | B08B 9/055 15/3.51 |
| 4,350,202 | A | * | 9/1982 | Schulz | F28G 1/12 15/3.51 |

FOREIGN PATENT DOCUMENTS

| | | | |
|---|---|---|---|
| CN | 102679806 | | 9/2012 |
| CN | 102788528 | | 11/2012 |
| CN | 202734668 | | 2/2013 |
| CN | 202853467 | | 4/2013 |
| CN | 202885650 | * | 4/2013 |
| CN | 203719533 | | 7/2014 |

* cited by examiner

RUBBER BALL CLEANING MULTIPOINT CENTRALIZED BALL SERVING SYSTEM FOR CONDENSER

TECHNICAL FIELD

The present invention belongs to the technical field of condenser circulating cooling water systems of thermal power plants, relates to a rubber ball cleaning system for a condenser circulating cooling water system, and used for cleaning of a steam turbine condenser circulating cooling water system of a thermal power plant.

RELATED ART

Most condenser circulating cooling water systems of steam turbine sets in the existing thermal power plants use rubber ball cleaning systems. The system can effectively remove impurities and fouling attached to an inner wall of a condenser circulating cooling water heat exchange pipe in time, to improve cleanliness of the inner wall of the heat exchange pipe, so as to improve heat exchange efficiency, keep a steam turbine set to operate in an optimal design condition, reduce exhaust loss, and improve economical efficiency of a thermodynamic system.

A rubber ball cleaning system majorly consists of a rubber ball recovery net, a rubber ball pump, a ball adding chamber, and a system valve and pipeline. The rubber ball recovery net is arranged on a water outlet pipe of a condenser circulating cooling water system and configured to intercept rubber balls carried in circulating cooling water at a water outlet side of the condenser. The intercepted rubber balls are pumped via a recovery net ball centralizing opening and inlet and outlet pipes of the rubber ball pump to the ball adding chamber under a suction effect of the rubber ball pump and are then sent to a condenser circulating cooling water inlet pipe via a valve pipe system connected to the condenser circulating cooling water inlet pipe, to implement a process in which rubber balls enter from a water inlet pipe of a condenser circulating cooling water system and are discharged from a ball recovery net on a water outlet pipe of the condenser circulating cooling water system, to circularly clean an inner wall of a condenser circulating cooling water heat exchange pipe.

The Patent, "RUBBER BALL CLEANING SYSTEM FOR CONDENSER CIRCULATING COOLING WATER SYSTEM OF THERMAL POWER PLANT" (with the patent number of ZL201220516865.X, the publication number of CN202885650, and the publication date of Apr. 17, 2013), discloses a rubber ball cleaning system. A hot water discharging pipe is provided on a ball adding chamber. When the rubber ball cleaning system is running, hot water that enters the ball adding chamber is discharged to a circulating cooling water outlet pipe, to reduce a flow rate of circulating cooling water that is heated during the rubber ball system running and enters a water inlet pipe of a circulating cooling water system, thereby helping to improve a condenser circulating cooling effect. By oppositely and correspondingly operating a rubber ball serving valve and a hot water discharging valve, the two valves are opened and closed intermittently to: recycle the heated circulating cooling water that enters the ball adding chamber from the rubber ball recovery net to the circulating cooling water outlet pipe in a ball centralizing process at the ball adding chamber, and enable a great number of rubber balls to centrally enter a circulating cooling water inlet pipe within a short time in a ball serving process, to improve a condenser cleaning effect. However, the technique also has certain limitations. One is that cleaning of the filtering net in the ball adding chamber after being contaminated by impurities in the cooling water is difficult; the second is that the volume of the ball adding chamber is small and better rubber ball stack area control is needed during centralized ball serving; and the third is that the existing system can only fully clean a condenser cooling pipe comparatively and there is a certain dead angle.

SUMMARY

An objective of the present invention is to provide a rubber ball cleaning multipoint centralized ball serving system for a condenser. In the system, a ball adding chamber receives more rubber balls, the cleaning rubber balls are distributed in the ball adding chamber in a way of being more beneficial to transferring, and impurities in the cooling water may not block a filtering net inside the ball adding chamber; a check valve is added at an outlet of the rubber ball pump, to avoid inverse rotation of the rubber ball pump; and more importantly, a serving valve is arranged more flexibly to implement extensive cleaning of a cooling pipe for a condenser water chamber, and the rubber ball cleaning system is more reliable and also more efficient.

To achieve the foregoing objective, a technical solution used by the present invention is: a rubber ball cleaning multipoint centralized ball serving system for a condenser, including a condenser water chamber, a circulating cooling water outlet pipe, and a circulating cooling water inlet pipe, the circulating cooling water outlet pipe being provided with a hopper-type ball recovery net which is connected to a ball adding chamber via a ball recovery pipe, and a second isolating valve, a rubber ball pump, and a check valve being sequentially arranged on the ball recovery pipe in a direction from the hopper-type ball recovery net to the ball adding chamber, where a circulating cooling water inlet end of the condenser water chamber is further separately connected to a plurality of pulse ball serving valves arranged in parallel; other ends of the plurality of pulse ball serving valves are all connected to a rubber ball transfer pipe, an inlet of the rubber ball transfer pipe is connected to a first isolating valve, and the first isolating valve is connected to the ball adding chamber; the rubber ball transfer pipe is connected to the circulating cooling water inlet pipe via a pipe provided with a third pulse ball serving valve; a top of the ball adding chamber is connected to the circulating cooling water outlet pipe via a hot water discharging pipe, and a third isolating valve and a hot water discharging valve are sequentially arranged on the hot water discharging pipe in a direction from the circulating cooling water outlet pipe to the ball adding chamber; and a lower portion of the ball adding chamber is connected to a rubber ball recovery basket via a pipe provided with a rubber ball discharge valve.

A backwash valve is connected in parallel to the first isolating valve to form a backwash pipe, one end of the backwash pipe being connected to the rubber ball transfer pipe and the other end of the backwash pipe being connected to the ball adding chamber.

The ball adding chamber includes a ball adding chamber housing, where a tee joint is provided in the ball adding chamber housing, two ports of the tee joint separately protrude out of a side wall of the ball adding chamber housing, one port being connected to one end of the backwash pipe and the other port being connected to one end of the rubber ball discharge valve; a third port of the tee joint faces upwards to be connected to an outlet of a hopper; an inlet port of the hopper is fixedly connected to an inner wall of the ball adding chamber housing, and a rubber ball adding opening, a peephole, and a rubber ball recovery opening are provided on a side wall of the ball adding chamber housing between the inlet port of the hopper and a cap of the ball adding chamber housing, the rubber ball recovery opening being connected to the check valve; a ball filtering net pipe is vertically mounted on the cap of the ball adding chamber housing; and a lower end of the ball filtering net pipe protrudes into the ball adding chamber housing, and an upper end of the ball filtering net pipe is connected to the hot water discharging pipe.

The ball filtering net pipe includes a barrel-shaped ball filtering net pipe body, where a bottomed end of the ball filtering net pipe body protrudes into the ball adding chamber housing and enters the hopper, several strip meshes are provided on a tube segment side wall inside the ball adding chamber housing and the bottom of the ball filtering net pipe body, and the other end of the ball filtering net pipe body protrudes out of the ball adding chamber housing to be connected to the hot water discharging pipe.

The tee joint is a reducer tee joint, a non-reducing port of the reducer tee joint being connected to the rubber ball transfer pipe and a reducing port of the reducer tee joint being connected to the rubber ball discharge valve.

The ball recovery pipe is provided with a pressure gauge, the pressure gauge being located between the second isolating valve and the rubber ball pump.

The ball adding chamber of the rubber ball cleaning multipoint centralized ball serving system is provided with a hot water discharging pipe, for discharging hot water that enters the ball adding chamber to the circulating cooling water outlet pipe, to reduce a quantity of the circulating cooling water that is heated during running of the rubber ball system and again enters the water inlet pipe of the circulating cooling water system, thereby helping to improve a condenser circulating cooling effect. By accordingly operating the hot water discharging valve and the pulse ball serving valves in communication with the circulating cooling water inlet pipe and the condenser water chamber according to needs, extensively covered cleaning of the heat exchange pipe of the condenser water chamber is completed when a great number of rubber balls centrally enter the circulating cooling water inlet pipe and the condenser water chamber.

In the figures: 1. condenser water chamber, 2. first pulse ball serving valve, 3. circulating cooling water inlet pipe, 4. second pulse ball serving valve, 5. third pulse ball serving valve, 6. rubber ball transfer pipe, 7. backwash valve, 8. first isolating valve, 9. ball adding chamber, 10. rubber ball discharge valve, 11. rubber ball recovery basket, 12. check valve, 13. rubber ball pump, 14. pressure gauge, 15. second isolating valve, 16. hopper-type ball recovery net, 17. third isolating valve, 18. circulating cooling water outlet pipe, 19. hot water discharging valve, 20. hot water discharging pipe, 21. ball adding chamber housing, 22. ball filtering net pipe, 23. mesh, 24. rubber ball recovery opening, 25. peephole, 26. hopper, 27. reducer tee, 28. rubber ball serving valve, 29. rubber ball adding opening.

DETAILED DESCRIPTION

The present invention is described in detail in combination with the accompanying drawings and the specific implementations below.

Figure 1:
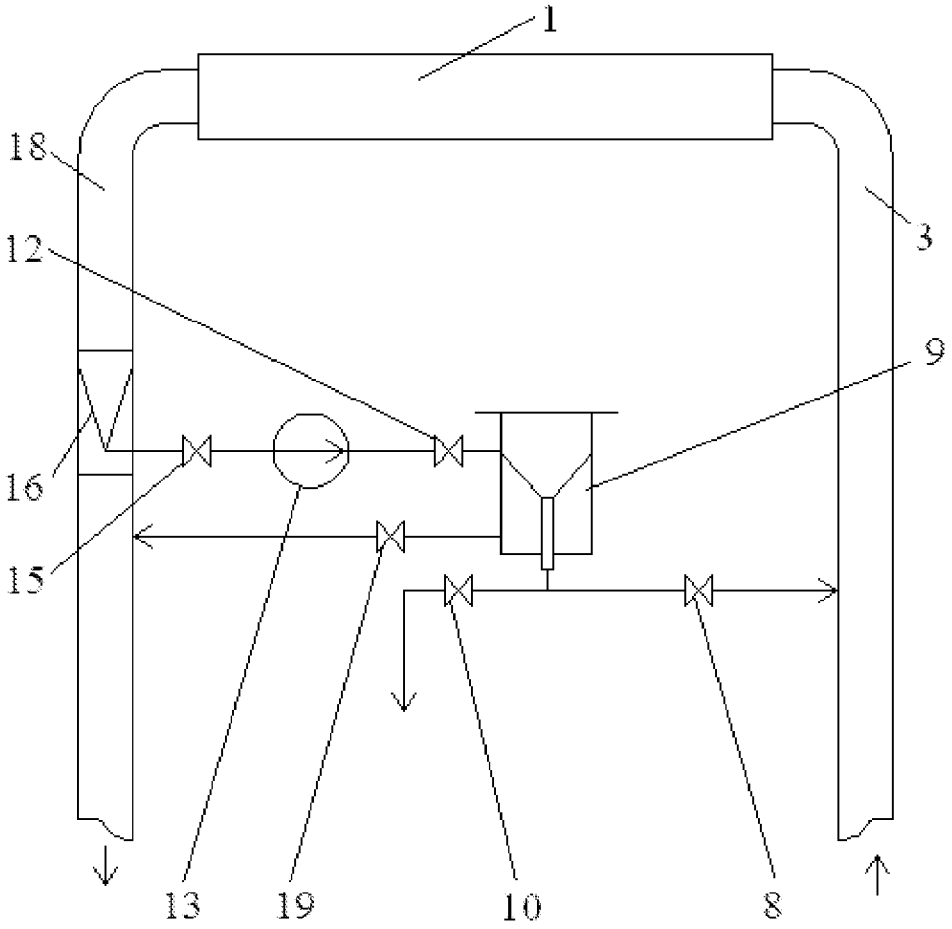
FIG. 1 is a principle system diagram of an existing rubber ball cleaning system.

The existing Patent, "RUBBER BALL CLEANING SYSTEM FOR CONDENSER CIRCULATING COOLING WATER SYSTEM OF THERMAL POWER PLANT" (with the patent number of ZL201220516865.X, the publication number of CN202885650U, and the publication date of Apr. 17, 2013), discloses a rubber ball cleaning system, as shown in FIG. 1, including a condenser water chamber 1. The condenser water chamber 1 is in communication with a circulating cooling water inlet pipe 3 and a circulating cooling water outlet pipe 18, separately. The circulating cooling water outlet pipe 18 is provided with a hopper-type ball recovery net 16. A ball centralizing opening of the hopper-type ball recovery net 16 is in communication with a ball inlet opening of a ball adding chamber 9 via a pipe. A second isolating valve 15, a rubber ball pump 13, and a check valve 12 are sequentially arranged on the pipe in a direction from the hopper-type ball recovery net 16 to the ball adding chamber 9. A ball outlet opening of the ball adding chamber 9 is in communication with the circulating cooling water inlet pipe 3 via a pipeline. The pipeline is provided with a third pulse ball serving valve 5. The ball outlet opening of the ball adding chamber 9 is further connected to the pipe provided with a rubber ball discharge valve 10. A hot water discharge opening of the ball adding chamber 9 is in communication with the circulating cooling water outlet pipe 18 via a pipe provided with a hot water discharging valve 19.

Figure 2:
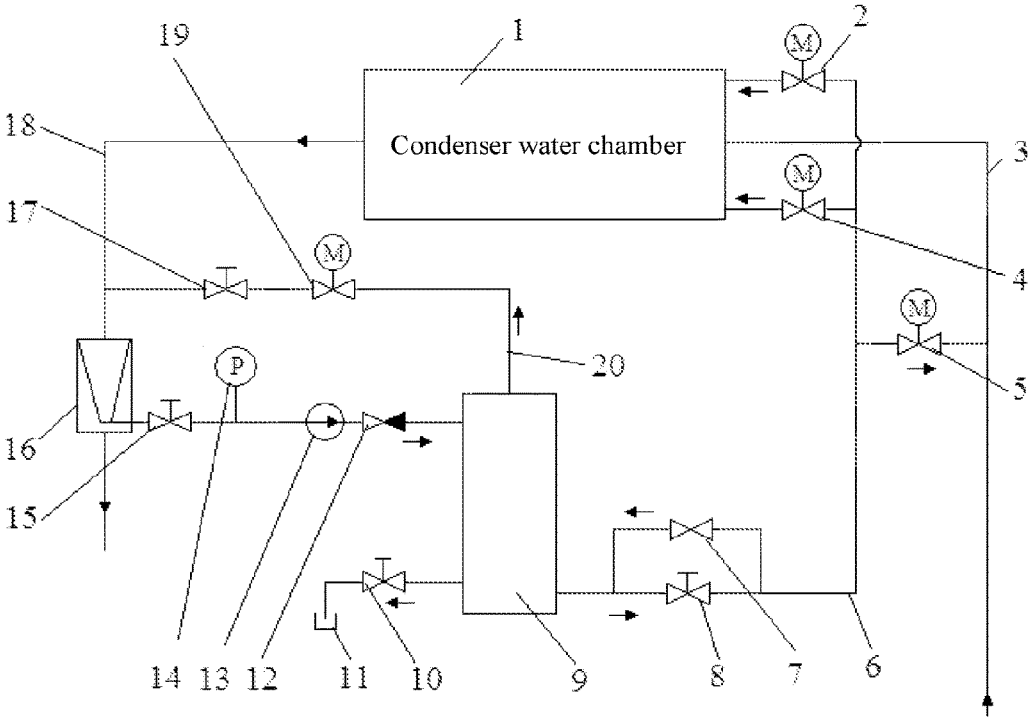
FIG. 2 is a principle system diagram of a rubber ball cleaning multipoint centralized ball serving system of the present invention.

In the Patent "RUBBER BALL CLEANING SYSTEM FOR CONDENSER CIRCULATING COOLING WATER SYSTEM OF THERMAL POWER PLANT", the rubber balls are centrally sent to the circulating cooling water inlet pipe 3, to implement large scale cleaning of the condenser heat exchange pipe. Meanwhile, high-temperature circulating cooling water that enters the ball adding chamber 9 is discharged to the circulating cooling water outlet pipe 18 in a ball centralizing period at the ball adding chamber 9, to reduce quantity of high-temperature water that enters the circulating cooling water inlet pipe 3 along with the rubber balls, so as to effectively improve a condenser cooling effect. However, impurities in the circulating cooling water of the rubber ball cleaning system may easily block a surface of a hopper inside the ball adding chamber 9, and are difficult to clean. The inner space of the ball adding chamber, which is not beneficial to uniform distribution of the rubber balls inside the ball adding chamber 9. A ball serving valve at an outlet of the ball adding chamber 9 is communicated only to the circulating cooling water inlet pipe, and full coverage cleaning of heat exchange pipes of a condenser water chamber cannot be implemented. No explicit design is provided for interception and cleaning of impurities of large particles in a circulating cooling water body, causing hidden risks to normal running of the rubber ball cleaning system. Therefore, the present invention provides a rubber ball cleaning multipoint centralized ball serving system, as shown in FIG. 2, so as to overcome the existing problems of the rubber ball cleaning system of the prior art.

The rubber ball cleaning multipoint centralized ball serving system of the present invention includes a condenser water chamber 1. A circulating cooling water outlet end of the condenser water chamber 1 is connected to a circulating cooling water outlet pipe 18. A circulating cooling water inlet end of the condenser water chamber 1 is separately connected to one end of a first pulse ball serving valve 2, one end of a circulating cooling water inlet pipe 3, and one end of a second pulse ball serving valve 4. The circulating cooling water outlet pipe 18 is further provided with a hopper-type ball recovery net 16. The hopper-type ball recovery net 16 uses the Patent "NOVEL HOPPER-TYPE RUBBER BALL RECOVERY NET" (with patent number of ZL201220297329.5, publication number of CN202734668, and publication date of Feb. 13, 2013). The hopper-type ball recovery net 16 is connected to a ball adding chamber 9 via a ball recovery pipe. A second isolating valve 15, a pressure gauge 14, a rubber ball pump 13, and a check valve 12 are sequentially arranged on the ball recovery pipe in a direction from the hopper-type ball recovery net 16 to the ball adding chamber 9. The other end of the first pulse ball serving valve 2 and the other end of the second pulse ball serving valve 4 are both connected to a rubber ball transfer pipe 6. An inlet of the rubber ball transfer pipe 6 is connected to the ball adding chamber 9 via a first isolating valve 8. The rubber ball transfer pipe 6 is connected to the circulating cooling water inlet pipe 3 via a pipeline provided with a third pulse ball serving valve 5. A lower portion of the ball adding chamber 9 is connected to a rubber ball recovery basket 11 via a pipeline provided with a rubber ball discharge valve 10. A top of the ball adding chamber 9 is connected to the circulating cooling water outlet pipe 18 via a hot water discharging pipe 20. A connecting point between the hot water discharging pipe 20 and the circulating cooling water outlet pipe 18 may be provided at any position in a front end or rear end of the hopper-type ball recovery net 16. A third isolating valve 17 and a hot water discharging valve 19 are sequentially arranged on the hot water discharging pipe 20 in a direction from the circulating cooling water outlet pipe 18 to the ball adding chamber 9.

Figure 3:
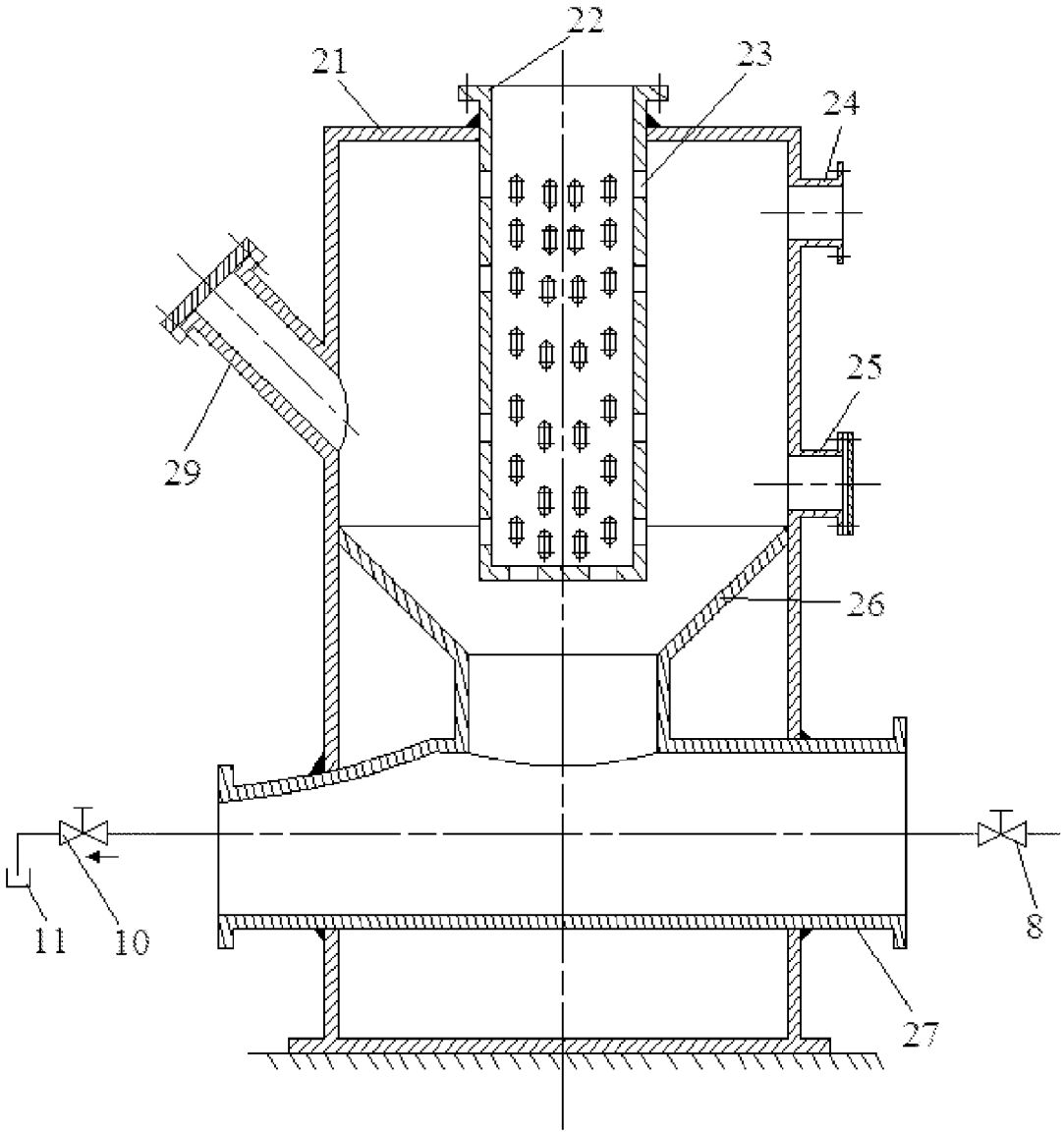
FIG. 3 is a schematic structural diagram of a ball adding chamber in the rubber ball cleaning multipoint centralized ball serving system of the present invention.

As shown in FIG. 3, the ball adding chamber 9 in the rubber ball cleaning multipoint centralized ball serving system includes a ball adding chamber housing 21. A reducer tee joint 27 is provided in the ball adding chamber housing 21. Two ports of the reducer tee joint 27 separately protrude out of a side wall of the ball adding chamber housing 21, a non-reducing port being connected to the first isolating valve 8 and the reducing port being connected to one end of the rubber ball discharge valve 10. A third port of the reducer tee joint 27 faces upwards to be connected to an outlet of a hopper 26. An inlet of the hopper 26 is fixedly connected to an inner wall of the ball adding chamber housing 21. A rubber ball adding opening 29, a peephole 25, and a rubber ball recovery opening 24 are provided on a side wall of the ball adding chamber housing 21 between the inlet end of the hopper 26 and a cap of the ball adding chamber housing 21. The rubber ball recovery opening 24 is connected to a check valve 12. A ball filtering net pipe 22 is vertically mounted on the top of the ball adding chamber housing 21. The ball filtering net pipe 22 includes a barrel-shaped ball filtering net pipe body. A bottomed end of the ball filtering net pipe body protrudes into the ball adding chamber housing 21 and enters the hopper 26. Several strip meshes 23 are provided on a tube segment side wall inside the ball adding chamber housing 21 and the bottom of the ball filtering net pipe body. The other end of the ball filtering net pipe body protrudes out of the ball adding chamber housing 21 to be connected to the hot water discharging pipe 20.

A working process of the rubber ball cleaning multipoint centralized ball serving system of the present invention is introduced by using FIG. 2 as an example below. Certain impurities of large particles exist in a water body, no matter circulating cooling water is taken from natural rivers and lakes or oceans. After being filtered by a trash-removal machine 6 to intercept and remove impurities of large particles in the water body, the circulating cooling water enters the condenser water chamber 1 via the circulating cooling water inlet pipe 3, and after absorbing heat, the circulating cooling water is transmitted via the circulating cooling water outlet pipe 18 to a cooling tower or a natural water body for heat dissipating, and reenters the circulating cooling water system by pumping. This is a running process of circulating cooling water system. To prevent suspended solids such as silts or high-concentration salts carried in the circulating cooling water from depositing inside the cooling pipe in the condenser water chamber to influence the heat exchange effect, cleaning of the inner portion of the cooling pipe is needed. The rubber ball cleaning system, as a common cleaning mode, is arranged in the system composed of the circulating cooling water inlet and outlet pipes and the condenser water chamber.

The running mode of the rubber ball cleaning multipoint centralized ball serving system of the present invention:

Standby state of the rubber ball cleaning system: A rubber ball adding opening 29 above the ball adding chamber housing 21 is opened to add a sufficient number of infiltrated qualified rubber balls, the rubber ball adding opening 29 is closed, and at this time the rubber ball cleaning system is in standby state. Operations are performed sequentially to enable hopper-type ball recovery net 16 to be in a working position, close the rubber ball discharge valve 10 and the backwash valve 7, open the first isolating valve 8, the second isolating valve 15, and the third isolating valve 17, enable the rubber ball pump 13, and open the hot water discharging valve 19. At this time, a cycle in which the circulating cooling water flows from a ball centralizing opening of the hopper-type ball recovery net 16, through the second isolating valve 15, the rubber ball pump 13, and the check valve 12, via the rubber ball recovery opening 24 on the ball adding chamber 9, into the ball adding chamber 9, enters the ball filtering net pipe 22 via the meshes 23, then enters the hot water discharging pipe 20, and sequentially flows, through the hot water discharging valve 19 and the third isolating valve 17, back to the circulating cooling water outlet pipe 18 for discharging is formed in the rubber ball cleaning multipoint centralized ball serving system. This cycle is a ball recovery process. In this process, the rubber balls centralized in the hopper-type ball recovery net 16 are intercepted and retained in the inner portion of the ball adding chamber housing 21 by the ball filtering net pipe 22 after entering the inner portion of the inner portion of the ball adding chamber 9 along with the circulating cooling water. Most rubber balls are uniformly attached to a tube wall of the ball filtering net pipe 22 under the water flow function. During the ball centralizing process, the hot water discharging valve 19 is closed and any one of the first pulse ball serving valve, the second pulse ball serving valve 4, or the third pulse ball serving valve 5 is opened rapidly. At this time, a cycle in which the circulating cooling water flows out of the ball centralizing opening of the hopper-type ball recovery net 16, sequentially flows through the second isolating valve 15, the rubber ball pump 13, and the check valve 12, and enters the inner portion of the ball adding chamber 9 via the rubber ball recovery opening 24 on the ball adding chamber 9, a large quantity of rubber balls attached to the tube wall of the ball filtering net pipe 22 flow through the hopper 26, the reducer tee joint 27, and the first isolating valve 8, and centrally enter the condenser water chamber 1 via any opened pulse ball serving valve of the three pulse ball serving valves along the rubber ball transfer pipe 29, for cleaning the inner walls of the cooling pipes of the condenser water chamber in a large scale, and subsequently the rubber balls flow out of the condenser water chamber 1, enter the circulating cooling water outlet pipe 18, and are intercepted by the hopper-type ball recovery net 16, for sequentially cleaning the inner walls of the condenser cooling pipes circularly is formed in the rubber ball cleaning multipoint centralized ball serving system. In the cleaning process, the hot water discharging valve 19 is opened and at the same time, the opened pulse ball serving valve is closed. The rubber balls running in the multipoint centralized ball serving system may be centrally recovered in peripheries of the ball filtering net pipe 22 in the ball adding chamber 9. At this time, the multipoint centralized ball serving system is in a ball recovery process.

In the present ball recovery process of the rubber ball cleaning multipoint centralized ball serving system, any two of the first pulse ball serving valve 2, the second pulse ball serving valve 4, and the third pulse ball serving valve 5 may also be opened simultaneously; and further the first pulse ball serving valve 2, the second pulse ball serving valve 4, and the third pulse ball serving valve 5 may be opened simultaneously.

The aforementioned process may be individually designed into different cleaning processes by using PLC control according to needs, to enable the rubber balls to centrally enter different portions of the inner portion of the condenser water chamber 1 and clean the inner walls of the condenser cooling pipes in full coverage by rubber ball cleaning multipoint centralized ball serving.

When the present rubber ball cleaning multipoint centralized ball serving system enters a certain ball recovery process after several times of cleaning process, operations are performed to enable the hopper-type ball recovery net 16 to be in non-working state, close the rubber ball pump, and close the hot water discharging valve 19. At this time, the present multipoint centralized ball serving system enters standby state.

Only when the rubber ball cleaning system stops running, the rubber ball discharge valve 10 opens to discharge the rubber balls in the ball adding chamber 9. When the rubber balls need to be updated, after the rubber ball discharge valve 10 is opened when the rubber ball cleaning multipoint centralized ball serving system is in the standby state, the rubber balls in the inner portion of the ball adding chamber 9 are discharged out of the ball adding chamber 9 via the reducer tee joint 7 and the rubber ball discharge valve 10 under the driving of water flow, and are recovered in the rubber ball recovery basket 11. To fully discharge the rubber balls in the ball adding chamber 9, a backwash pipe is provided in the rubber ball cleaning multipoint centralized ball serving system of the present invention. The backwash pipe consists of the first isolating valve 8 and a backwash valve 7 connected to the first isolating valve 8 in parallel. One end of the backwash pipe is connected to the ball adding chamber 9, and the other end of the backwash pipe is connected to the rubber ball transfer pipe 6. When the rubber ball cleaning multipoint centralized ball serving system of the present invention is in ball recovery state and ball serving state, the backwash valve 7 is closed and the system works normally. When the rubber ball cleaning multipoint centralized ball serving system is in standby state, to fully remove all rubber balls in the ball adding chamber 9, at this time, any one of the pulse ball serving valves is opened and a backwash valve 7 is opened, so as to enable the cooling eater in the circulating cooling water inlet pipe 3 to inversely flow into the rubber ball transfer pipe 6, enter the reducer tee joint 27, and wash the reducer tee joint 27, to ensure that no unqualified rubber ball is retained in the ball adding chamber 9.

According to a tube plate structure of the condenser water chamber 1, different quantities of rubber ball feeding openings may be arranged on a housing at a water inlet end of the condenser water chamber 1 and one pulse ball serving valve is mounted on each rubber ball feeding opening.

What is claimed is:

1. A rubber ball cleaning multipoint centralized ball serving system for a condenser, comprising a condenser water chamber, a circulating cooling water outlet pipe, and a circulating cooling water inlet pipe, the circulating cooling water outlet pipe being provided with a hopper-type ball recovery net which is connected to a ball adding chamber via a ball recovery pipe, and a second isolating valve, a rubber ball pump, and a check valve being sequentially arranged on the ball recovery pipe in a direction from the hopper-type ball recovery net to the ball adding chamber, wherein a circulating cooling water inlet end of the condenser water chamber is further separately connected to a plurality of pulse ball serving valves arranged in parallel; other ends of the plurality of pulse ball serving valves are all connected to a rubber ball transfer pipe, an inlet of the rubber ball transfer pipe is connected to a first isolating valve, and the first isolating valve is connected to the ball adding chamber; the rubber ball transfer pipe is connected to the circulating cooling water inlet pipe via a pipe provided with a third pulse ball serving valve; a top of the ball adding chamber is connected to the circulating cooling water outlet pipe via a hot water discharging pipe, and a third isolating valve and a hot water discharging valve are sequentially arranged on the hot water discharging pipe in a direction from the circulating cooling water outlet pipe to the ball adding chamber; and a lower portion of the ball adding chamber is connected to a rubber ball recovery basket via a pipe provided with a rubber ball discharge valve.

2. The rubber ball cleaning multipoint centralized ball serving system for the condenser according to claim 1, wherein a backwash valve is connected in parallel to the first isolating valve to form a backwash pipe, one end of the backwash pipe being connected to the ball adding chamber and the other end of the backwash pipe being is connected to the rubber ball transfer pipe.

3. The rubber ball cleaning multipoint centralized ball serving system for the condenser according to claim 1, wherein the ball adding chamber comprises a ball adding chamber housing, a tee joint is provided in the ball adding chamber housing, two ports of the tee joint separately protrude out of a side wall of the ball adding chamber housing, one port being connected to one end of a backwash pipe and the other port being connected to one end of the rubber ball discharge valve; a third port of the tee joint faces upwards to be connected to an outlet of a hopper; an inlet port of the hopper is fixedly connected to an inner wall of the ball adding chamber housing, and a rubber ball adding opening, a peephole, and a rubber ball recovery opening are provided on a side wall of the ball adding chamber housing between the inlet port of the hopper and a cap of the ball adding chamber housing, the rubber ball recovery opening being connected to the check valve; a ball filtering net pipe is vertically mounted on the cap of the ball adding chamber housing; and a lower end of the ball filtering net pipe protrudes into the ball adding chamber housing, and an upper end of the ball filtering net pipe is connected to the hot water discharging pipe.

4. The rubber ball cleaning multipoint centralized ball serving system for the condenser according to claim 3, wherein a ball filtering net pipe comprises a barrel-shaped ball filtering net pipe body, a bottomed end of the ball filtering net pipe body protrudes into the ball adding chamber housing and enters the hopper, several strip meshes are provided on a tube segment side wall inside the ball adding chamber housing and the bottom of the ball filtering net pipe body, and the other end of the ball filtering net pipe body protrudes out of the ball adding chamber housing to be connected to the hot water discharging pipe.

5. The rubber ball cleaning multipoint centralized ball serving system for the condenser according to claim 3, wherein the tee joint is a reducer tee joint, a non-reducing port of the reducer tee joint being connected to the backwash pipe and a reducing port of the reducer tee joint being connected to the rubber ball discharge valve.

6. The rubber ball cleaning multipoint centralized ball serving system for the condenser according to claim 1, wherein the ball recovery pipe is provided with a pressure gauge, the pressure gauge being located between the second isolating valve and the rubber ball pump.

7. The rubber ball cleaning multipoint centralized ball serving system for the condenser according to claim 1, wherein a connecting point between the hot water discharging pipe and the circulating cooling water outlet pipe is located at a front end of the hopper-type ball recovery net or a rear end of the hopper-type ball recovery net.

* * * * *